United States Patent [19]

Sifford

[11] 3,990,807

[45] Nov. 9, 1976

[54] THERMAL RESPONSE SHROUD FOR ROTATING BODY

[75] Inventor: Perry P. Sifford, Jupiter, Fla.

[73] Assignee: United Technologies Corporation, Hartford, Conn.

[22] Filed: Dec. 23, 1974

[21] Appl. No.: 535,933

[52] U.S. Cl. ..... 415/136; 415/217; 415/218; 415/115

[51] Int. Cl.[2] ..... F01D 5/14; F01D 25/26

[58] Field of Search ..... 415/115, 116, 134, 136, 415/138, 217, 218

[56] References Cited

UNITED STATES PATENTS

| | | | |
|---|---|---|---|
| 2,427,244 | 9/1947 | Warner | 415/136 |
| 2,488,867 | 11/1949 | Judson | 415/217 |
| 2,488,875 | 11/1949 | Morley | 415/136 |
| 2,557,898 | 6/1951 | Thompson | 415/135 |
| 2,793,832 | 5/1957 | Wheatley et al. | 415/115 |
| 2,859,011 | 11/1958 | Zimmerman | 415/217 |
| 2,859,934 | 11/1958 | Halford et al. | 415/115 |
| 3,295,823 | 1/1967 | Waugh et al. | 415/136 |
| 3,644,057 | 2/1972 | Steinbarger | 415/218 |
| 3,945,758 | 3/1976 | Lee | 415/144 |

*Primary Examiner*—Henry F. Raduazo
*Attorney, Agent, or Firm*—Jack N. McCarthy

[57] ABSTRACT

This invention shows a shroud construction located around the tips of the blades on a rotating body in an engine to provide a minimum clearance between the blade tips and the shroud during all conditions of operation-acceleration, steady state and deceleration. This shroud construction provides an arrangement where the internal diameter of the vanes support the shroud member for the tips of the blades. The vane is supported as internal diameter to an internal support while the outer diameter of the vane is permitted radial growth with respect to the turbine casing. While the blade tip shroud can be made integral with the outer shroud of the vanes, it may be connected by means which will permit a small axial misalignment. Means are provided for cooling the shrouds around the tips of the blades.

8 Claims, 3 Drawing Figures

THERMAL RESPONSE SHROUD FOR ROTATING BODY

The invention herein described was made in the course of or under a contract with the Department of the Air Force.

BACKGROUND OF THE INVENTION

This invention relates to a device for minimizing the clearance between blade tips and surrounding shroud. In this art, many different types of shroud have been used. A sample of these are shown by U.S. Pat. Nos. 3,391,904; 2,859,934; 3,443,791 and 3,742,705. Turbine blade tip clearance is difficult to control because blade tip growth is made up of two elements that are different in thermal response rate; the blade responds rapidly while the disk responds more slowly. Presently, attempts are made to control blade tip clearance by trying to duplicate blade tip growth with a third element.

SUMMARY OF THE INVENTION

A primary object of the present invention is to improve thermal growth compatibility between blade tips and shroud to reduce interference and increase engine performance.

In accordance with the present invention the shroud position is governed by movement of the vanes which reduce tip clearance change to surge or aircraft maneuvers.

It is an object of this invention to improve the gas path seal between the blade and vane platforms at their internal diameter.

A further object of this invention is to provide shroud arrangement in which the blade tip shroud is responsive to vane internal diameter support, wherein the internal diameter vane support acts as a disk growth simulator and the vane acts as a blade growth simulator. The internal diameter support of the vane can have its response rate adjusted by changing its heat transfer convection rate; this can be done by controlling the material of the support and its shielding and cooling.

Another object of this invention is to provide for growth of the outer diameter of the vane within the turbine casing so that the movement of the outer diameter of the vane is not affected by the growth of the case.

A further object of this invention is to provide cooling means in the blade tip shroud to further aid in eliminating shroud warping. The flow can be injected onto a sheet metal seal to eliminate direct impingement cooling on the shroud itself. Coolant flow spaces were made spherical to reduce conduction into the sheet metal seal.

Another object of the invention is to provide a shroud support which is not integral with the vanes, yet radial growth is controlled by the vanes. This allows tilt of the shrouds to be controlled independently of the tilts of the vanes.

DESCRIPTION OF THE PREFERRED EMBODIMENT

Figure 1:
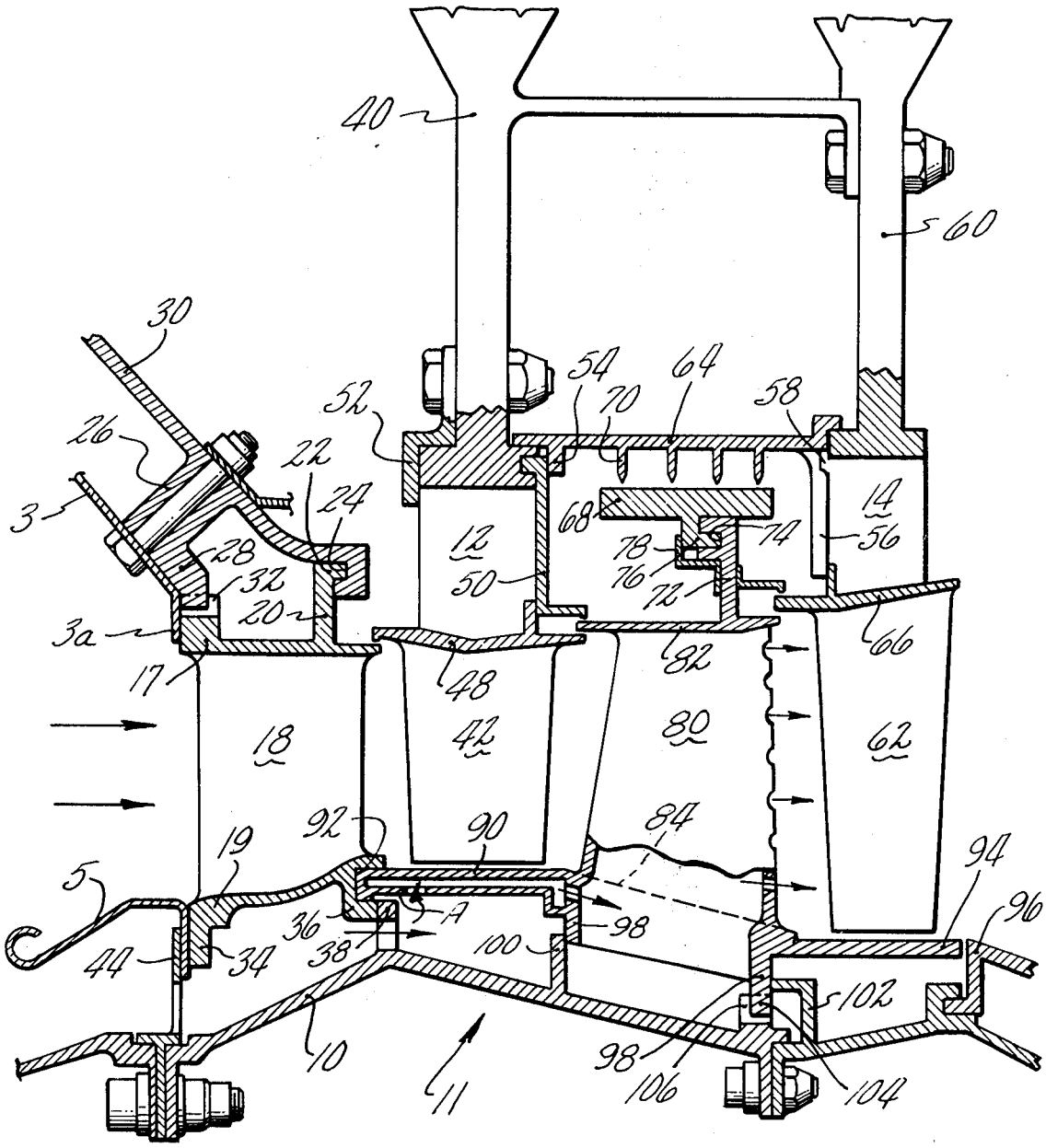
FIG. 1 is a sectional view of the invention showing the rotor discs and blades and the stationary vanes along with the supporting structure.

The turbine section 11 shown in FIG. 1 is located in the same environment as the turbine section of U.S. Pat. No. 3,826,084. This turbine section 11 comprises a gas path having first stage vanes 18, first stage blades 42, second stage vanes 80, and second stage blades 62. The first stage vanes 18 are mounted in pairs of two between inner shroud segments 17 and outer shroud segments 19. There could be 23 shroud segments 17 and 19 forming comlete inner and outer shrouds, with a total of 46 blades. The inner shroud segments 17 each have an inwardly extending flange 20 adjacent its rearward end with a rearwardly extending foot 22 at its inner extremity. An inner support flange 30 extending outwardly from fixed inner structure on the engine has a forwardly facing annular groove 24 thereon which is positioned to receive the feet 22 of the first stage vanes 18.

Projections 26 extend forwardly from the inner support flange 30, one for each pair of vanes 18 with each projection having an outwardly extending positioning projection 28 which engages a notch 32 in a short inwardly extending projection at the forward part of inner shroud section 17. This positions the first stage vanes 18 around the inner support flange 30. The inner ends of each pair of vanes 18 are held in place by member 3a which is fixed to the outer end of the projection 26 and contacts the forward face of the inner shroud segment 17.

The outer shroud segments 19 each have an outwardly extending flange 34 adjacent its forward end and outwardly extending flange 36 at its rearward end. These flanges are positioned between an inwardly extending annular flange 38 on casing 10 and an inwardly extending annular resilient flange 44 which is held at its outer edge between two sections of the casing 10. The rear end of burner means (not shown) is sealed by flange members 3 and 5 which extend forwardly from the forward part of the turbine section 11. Flange members 3 are fixed to the projections 26 while flange members 5 are fixed to the flange member 44. This flange member 5 can be riveted to the flange 44.

The first stage blades 42 have roots 12 which are positioned in slots on the outer periphery of a first stage rotor disk 40. The blades 42 each have a platform 48 which form with each other an inner annular member. The forward edge of the blade platforms 48 are positioned adjacent the rearward edges of the inner shroud segments 17 to form a gas path seal at that point. Side plates 50 and 52 are fixed to the disc 40 to retain the blade roots of all the blades therein.

A second stage rotor disc 60 is positioned rearwardly of rotor disc 40. Rotor disc 60 has second stage blades 62 mounted thereon with roots 14 positioned in slots on the outer periphery thereof, in a manner similar to that used on rotor 40. A cylindrical spacing and seal member 64 extends between the rotor discs 40 and 60. The forward end of the member 64 has an outwardly extending flange 54 which is fixed to the disc 40 and positioned over the side plate 50. The rear end of the member 64 has an outwardly extending annular flange member 56 which forms a side plate for the front of the rotor disc 60. A tang 58 integral with the blade root contacts the front of rotor disc 60 to retain the blade roots of all of the blades with side plate 56. The blades 62 each have a platform 66 which form with each other an inner annular member.

A plurality of second stage vanes 80 are positioned between the first stage blades 42 and the second stage blades 62. The second stage vanes 80 are mounted in pairs of two between inner shroud segments 82 and outer shroud segments 84. The inner shroud segments 82 of vanes 80 are each fixed at their inner ends to a ring 68 which is positioned around projects 70 on member 64. The outer tips of these projections 70 form a seal with the inner surface of the ring member 68. A flange 72 extends inwardly from each inner shroud segment 82 and has a forwardly positioned groove 74 therein. The grooves 74 of each flange 72 form an annular groove which receives an annular flange member 76 which extends rearwardly from ring 68. This positions the inner ends of the second stage vanes 80 in a radial direction. The ring 68 is fixed in relation to the flange 72 to prevent relative axial movement therebetween. While this is shown by the use of a holding bracket 78, other means can be used if desired.

A flange member 90 extends forwardly from each outer shroud segment 84. These flange members 90 form an annular outer shroud around the blade tips of the first stage blades 42. The forward ends of the flange members 90 are received in a rearwardly facing slot 92 formed in the outwardly extending flange 36 at the rearward end of the first stage vanes 18. These slots are located radially inward from the inner end of the annular flange 38. A space "A" is provided for a differential in radial movement between the flange member 90 and the inner end of flange 38.

A flange member 94 extends rearwardly from each outer shroud segment 84. These flange members 94 form an annular outer shroud around the blade tips of the second stage blades 62. The rearward ends of the flange members 94 are positioned adjacent a wall 96 which is fixed to the casing 10 and provides the outer surface which guides the gas flow through the turbine section.

Each second stage vane 80 projects outwardly from the outer shroud segments 84 at 98. The outwardly projecting portion 98 is guided radially between a flange 100 extending inwardly from casing 10 and a flange 102 extending inwardly from said casing 10. To center the ring member 68, a plurality of second stage vanes 80 each having a lug 104 projecting radially outwardly which fits into a cooperating notch 106 formed on the casing 10.

This scheme also provides closely controlled gas path seals between shroud members 48 and 82 and also between 82 and 66.

Figure 2:
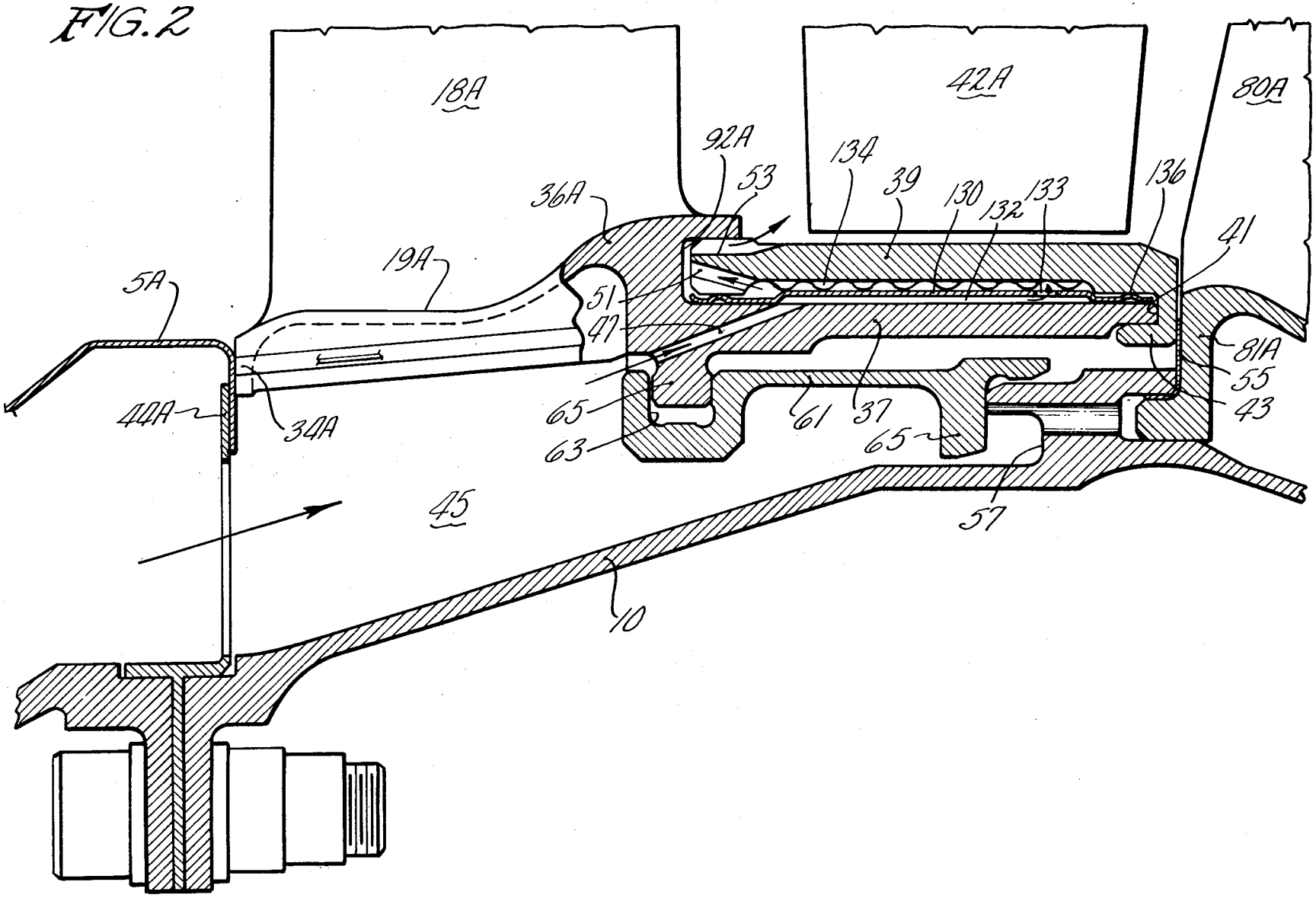
FIG. 2 is a modification of the arrangement shown in FIG. 1.

In the modification of the invention as shown in FIG. 2, the inner diameter of the first stage vane 18A is fixed in the same manner as the first stage vane 18 of FIG. 1, and the first stage blade 42A is formed in the same manner as blade 42 of FIG. 1 and can have the same type of blade connection and rotor disc. The outer diameter of the first stage vane 18A is constructed similar to the one shown in FIG. 1 except that each flange 36A has a rearwardly extending integral flange member 37. These flange members 37, which form a ring, carry a plurality of separate shroud members 39. The forward ends of the shroud members 39 fit in a groove 92A formed in the outwardly extending flanges 36A inside of the flange member 37. The rear end of the flange member 37 extends into a forwardly facing slot 41 located in an outwardly extending flange 43.

To provide for sealing a coolant flow from a chamber 45 to the interior of each shroud member 39, a multl-piece annular sheet metal seal 130 is positioned between the inner surface of the flange members 37 and the outer surface of the separate shroud members 39.

A sheet metal shroud such as shown here is disclosed in U.S. Pat. No. 3,836,279. The sheet metal seal is formed having a raised portion 136 around the edge thereof to provide a biasing force between the members 37 and 39. The seal 130 is built so as to provide a chamber 132 between the members 37 and 130, and the outer surface of the members 39 are provided with a plurality of raised nodules or bumps 134 on which the inner surface of seal 130 rests. It can be seen that a fluid under pressure entering the cavity 45 will flow through a passageway 47 in each flange 36A and flange member 37 into each chamber 132 at its forward end where it is directed to the other side of the seal 130 at its rearward end through an opening 133 where it flows by and around the raised nodules or bumps 134 through a passageway 51, the space between the forward end of member 39 and bottom of groove 92A to passageway 53 to the upstream end of the blade tip 42A.

A sheet metal seal 55 is located between the rear end of the shroud members 39 and the forward part of a flange 81A at the outer diameter of the second stage vanes 80A. This seal 55 extends outwardly to a location between a T-shaped member 57 extending inwardly from casing 10 and the forward part of flange 81A. An annular spacer member 61 is provided with an inwardly projecting annular groove 63 which receives an outwardly extending flange 65 positioned outwardly from the rear end of each pair of vanes 18A. The spacer 61 is provided with an outwardly extending annular flange 65 at its rearward end which abuts the forward part of the T-shaped member 57 to axially position the vane and shroud assembly.

Figure 3:
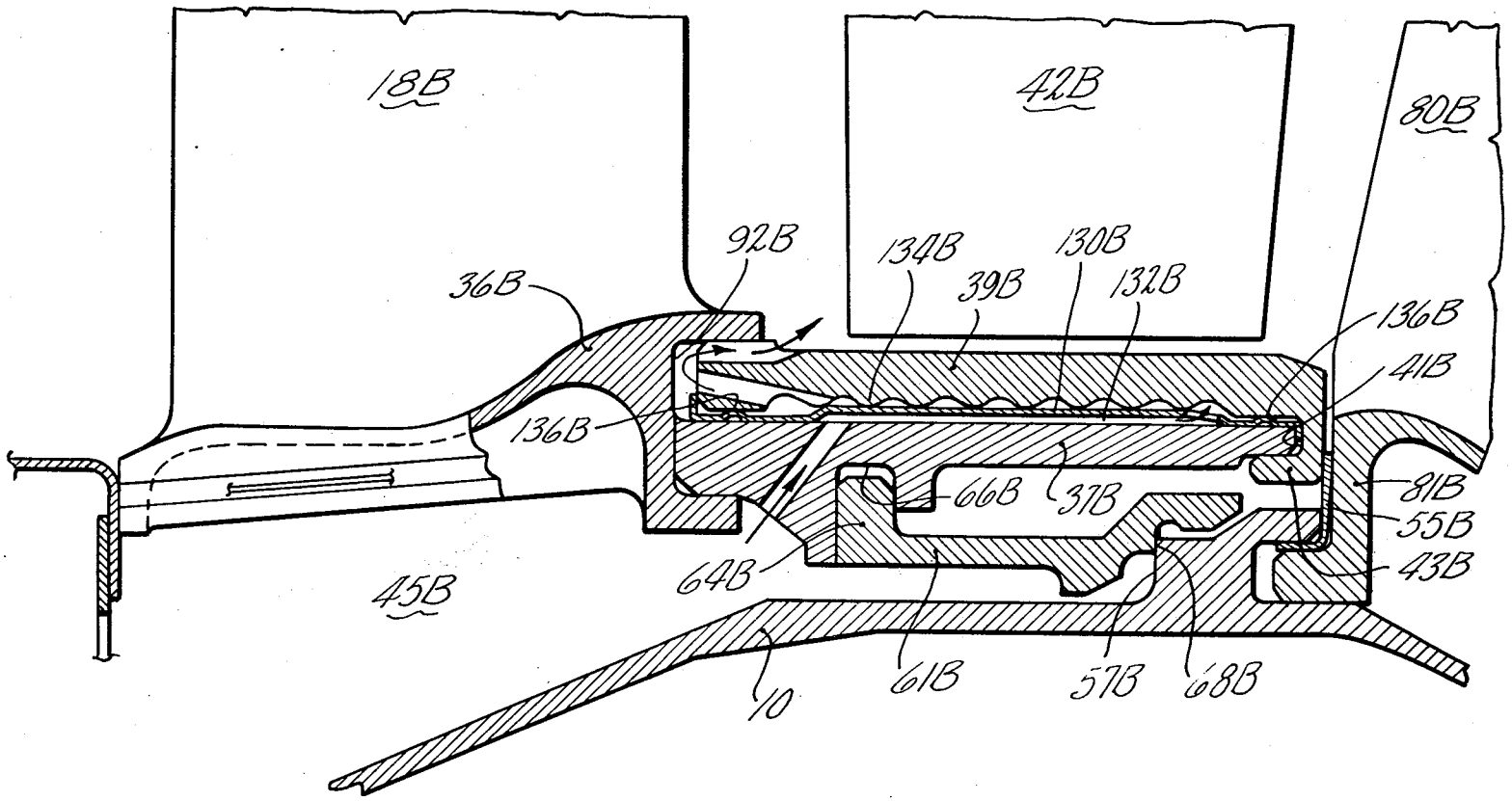
FIG. 3 is a modification of the arrangement shown in FIG. 2.

In the modification of the invention as shown in FIG. 3, the inner diameter of the first stage vane 18B is fixed in the same manner as the first stage vane 18 of FIG. 1, and the first stage blade 42B is formed in the same manner as blade 42 of FIG. 1 and can have the same type of blade connection and rotor disc. The outer diameter of the first stage vane 18B is constructed similar to the one shown in FIG. 2 except that the shroud support member 37B is not integral therewith. These shroud support members 37B, which form a ring, carry a plurality of separate shroud members 39B. The forward ends of the members 39B and 37B fit in a groove 92B, formed in the outwardly extending flanges 36B. The rear end of the shroud support member 37B extends into a forwardly facing slot 41B located in an outwardly extending flange 43B.

To provide for sealing a coolant flow from a chamber 45B to the interior of each shroud member 39B, a multi-piece annular sheet metal seal 130B is positioned between the inner surface of the shroud support members 37B and the outer surface of the separate shroud members 39B.

A sheet metal shroud such as shown here is disclosed in U.S. Pat. No. 3,836,279. The sheet metal seal is formed having a raised portion 136B around the edge thereof to provide a force biasing the members 37B and 39B apart. The seal 130B is built so as to provide a chamber 132B between the member 37B and 130B, and the outer surface of the members 39B are provided with a plurality of raised nodules or bumps 134B on which the inner surface of seal 130B rests. The cooling flow passes from cavity 45B to the blade tips in the same manner as shown in FIG. 2.

A sheet metal seal 55B is located between the rear end of the shroud members 39B and the forward part of a flange 81B at the outer diameter of the second stage vanes 80B. This seal 55B extends outwardly to a location between a projecting member 57B extending inwardly from casing 10 and the forward part of flange 81B. An annular spacer member 61B is provided with an inwardly projecting annular flange 64B which fits into a groove 66B positioned to open outwardly from the rear end of each shroud support member 37B. The spacer 61B is provided with an abutment 68B at its rearward end which abuts the forward part of the member 57B to axially position the vane and shroud assembly. The main additional feature of FIG. 3 over FIG. 2 is that the shroud support member 37B is not integral with the vanes. This allows axial tilt of the shrouds to be controlled independently of the vanes axial tilt, yet radial growth is controlled by the vanes. In this modification, to aid in maintaining the shroud support member 37B perpendicular to the engine center line it is made up of four (4) sections. It is noted that there is one shroud member 39B for each two vanes and that the spacer 61B is annular.

It is noted that the passageways 53 are located at an angle so that the fluid passing therethrough exits in a direction matching the flow exiting from the vanes 18A to increase the efficiency of the turbine.

I claim:

1. In combination a turbine assembly having an outer case, a plurality of vanes, a plurality of blades mounted for rotation adjacent thereto, shroud means extending over the tips of said blades, means fixedly mounting the inner diameter of said vanes at one location against relative radial movement with respect to an inner engine support, means mounting said outer diameter of said vanes for radial growth independently of the outer case, said shroud means being connected to the outer diameter of said vanes for radial movement therewith, said means fixedly mounting the inner diameter of said vanes being located at the rearward end of said vanes adjacent the blades permitting pivotal movement, said plurality of vanes forming a rearwardly facing annular slot at their outer diameter, said shroud means comprising (a) an annular inner means adjacent the tips of the blades, (b) a shroud support means located therearound, and (c) an annular spacer means for axially positioning the shroud support means, said annular inner means having its forward end projecting into said rearwardly facing annular slot, the rearward end of said shroud support means being fixed against radial movement with respect to said annular inner means, said annular spacer means having its forward end attached to said shroud support means so as to axially space said shroud support means relative to the outer case while permitting radial movement therebetween.

2. A combination as set forth in claim 1 wherein said shroud support means has its forward end located adjacent the forward end of the annular inner means with its forward end projecting into said rearwardly facing annular slot.

3. A combination as set forth in claim 1 wherein said annular inner means is made up of a plurality of arcuate members.

4. In combination, a turbine assembly having an outer case, a plurality of vanes, a plurality of first blades mounted for rotation adjacent the forward edge of said vanes, a plurality of second blades mounted for rotation adjacent the rear edge of said vanes, means mounting said outer diameter of said vanes for radial growth independently of the outer case, first shroud means spaced inwardly from said outer case extending around the tips of said first blades, second shroud means spaced inwardly from said outer case extending around the tips of said second blades, said first shroud means being integral with and connected at its rearward end to said vanes, said second shroud means being integral with and connected at its forward end to said vanes.

5. A combination as set forth in claim 4 including means connecting the inner diameter of said vanes to a ring, lug means on the outer diameter of said vanes projecting radially outwardly therefrom, said lug means engaging notches in the casing to keep the ring centered with said outer case.

6. A combination as set forth in claim 4 including a plurality of second vanes located forwardly of said blades, means fixedly mounting the inner diameter of said second vanes at one location against relative radial movement with respect to an inner engine support, means mounting the outer diameter of said second vanes for radial growth independently of the outer case, said first shroud means being connected at its forward end to said second vanes to move radially therewith.

7. In combination a turbine assembly having a plurality of first vanes, a plurality of blades mounted for rotation adjacent thereto, shroud means extending over the tips of said blades, means fixedly mounting the inner diameter of said first vanes at one location against relative radial movement with respect to an inner engine support, means mounting said outer diameter of said first vanes for radial growth independently of the outer case, said shroud means being connected to the outer diameter of said first vanes for radial movement therewith, a plurality of second vanes located adjacent the other side of said plurality of blades, said shroud means being connected to the outer diameter of said second vanes for radial movement therewith.

8. A combination as set forth in claim 7 wherein one end of said shroud means is integral with one of said plurality of vanes while the other end of said shroud means is removably attached to the outer diameter of said other plurality of vanes.

* * * * *